United States Patent [19]

Marie et al.

[11] Patent Number: 5,044,283

[45] Date of Patent: Sep. 3, 1991

[54] FREE TRANSFER MACHINE, WITH INDEPENDENT, MOTORIZED CARRIAGES AND WITH MODULE FOR ORIENTATION OF SUCH CARRIAGES

[75] Inventors: Bruno A. E. Marie, Roche la Moliere; Etienne M. Teissier, Chabeuil, both of France

[73] Assignee: Adl Automation, Malissard, France

[21] Appl. No.: 421,955

[22] Filed: Oct. 16, 1989

[30] Foreign Application Priority Data

Oct. 17, 1988 [FR] France ..... 88 14302
Jun. 30, 1989 [FR] France ..... 88 09077

[51] Int. Cl.[5] ..... B61J 1/12
[52] U.S. Cl. ..... 104/88; 104/48
[58] Field of Search ..... 104/130, 88, 48, 50, 104/96, 99, 103

[56] References Cited

U.S. PATENT DOCUMENTS 3,348,497 10/1967 Mattsson ..... 104/130
3,788,233 1/1974 Colovas et al. ..... 104/88
3,799,062 3/1974 Stöcker ..... 104/96 X
3,872,793 3/1975 Patin ..... 104/130
4,416,202 11/1983 Rooklyn ..... 104/88

FOREIGN PATENT DOCUMENTS 510916 5/1952 Belgium .
0284316 9/1988 European Pat. Off. .
2565921 5/1985 France .

*Primary Examiner*—Robert J. Oberleitner
*Assistant Examiner*—Alfred Muratori
*Attorney, Agent, or Firm*—Bacon & Thomas

[57] ABSTRACT

This invention relates to transfer machines, wherein the circulation trackway has at least two segments defining a given angle and a module for orientation of motorized carriages. Each carriage has at least one lateral group of rollers located on a median trasnverse axis of the carriage which are adapted to cooperate with the lateral guide slideway. The invention is applicable to transfer machines with motorized, free carriages.

19 Claims, 7 Drawing Sheets

13
14₁
14₂
15
14
5
2
2
7
25
26
27
27
R₁
R₂
S₁
S₂
Z
17₁
17₂
18
16
22
23
23
C
x
x
y
f₁
α
β
β
III
III
IV
IV
V
V
VII
VII

S1
S3
x
x
x
20
17₁
42
43
34
35
30
31
18
16
17₂
f1
14
20
32
33

FREE TRANSFER MACHINE, WITH INDEPENDENT, MOTORIZED CARRIAGES AND WITH MODULE FOR ORIENTATION OF SUCH CARRIAGES

FIELD OF THE INVENTION

The present invention relates to the transport of various loads or workpieces between work or operating stations, monitoring stations, assembly stations, mounting stations, testing stations, etc.

BACKGROUND OF THE INVENTION

The need to resort to an automatic transfer between successive work stations has already been felt for a long time, in order to rationalize a process of manufacture, of assembly, of mounting or of treatment and to reduce, if not eliminate, human intervention at each operational phase of such a process.

To attain this object, the prior art has proposed several solutions which may be classified in two families corresponding, respectively, to transfer machines with bound carriages and to transfer machines with free carriages.

The present invention concerns the transfer machines with free carriages and, more particularly, to those comprising independent and motorized free carriages.

Such transfer machines have incontestably brought considerable improvements, particularly by offering a possibility of modulating the speed of displacement of each carriage between the work stations.

The implantation of such machines and starting up thereof have, however, shown that, despite the undeniable advantages that they bring, they are still penalized by the absence of suppleness offered by their configuration in the possibility of adaptation of the circulation circuit that they define for the carriages.

Now, the economical imperatives of use of such transfer machines, of a high cost price, involve their being able to offer an adaptation of the configuration of the trackway for circulation of the carriages in order to ensure therefor a flexibility of use for the development of monitoring, assembly, mounting, testing processes capable of knowing phases of development which vary depending on the requirements of intervention on the loads or workpieces borne by the carriages and transferred by the latter from station to station.

Furthermore, a transfer machine presenting at least one rectilinear trackway for circulation, frequently requires the implantation of by-passes to bring the carriages opposite work stations excluded from the line of orientation, when, for example, their time of operation is greater than the longest having been taken as base for determining the overall operational cycle.

In such a case, it is therefore necessary to provide an outlet by-pass, a trackway for orientation up to the station and a return by-pass for the carriage to be able to reintegrate the principal circulation trackway.

In implantations of more or less complex type, by-passes are also frequently encountered for contiguous stations with, therefore, the same requirements.

In such a case, it is necessary to provide for two contiguous derivative stations and for each of them, an inlet by-pass, a transfer branch and an outlet by-pass.

The installation therefore employs contiguous by-passes with specific functions which considerably increase the implantation and bulk.

In addition to the above configuration, it would also be desirable, in transfer machines with more or less complex circulation circuit, i.e. initially designed to offer a considerable flexibility of adaptation, to be able to have a module able to ensure communication between two circulation trackways of privileged or principal character.

Such a possibility would enable carriages to be transferred from one trackway to the other in accordance with the program of circulation to be followed temporarily with the same installation capable of being employed for different programs.

SUMMARY OF THE INVENTION

It may therefore be considered that the present technique expresses the need to have available a transfer machine with free, independent and motorized carriages, comprising means for orienting the carriages along the circulation trackway which may thus present, in plan, a flexible configuration in relation with different work stations.

The object of the invention is to propose simple, robust and efficient means for changing the path of the carriages and for modifying the organization in plan of the circulation trackway.

The object of the invention is more particularly designed to allow the implantation of changes in direction or of bends in the circulation circuit defined by the trackway.

Another object of the invention is also to render possible the implantation of switching stations enabling a carriage to be directed along a section of circulation trackway towards one or the other of two by-pass trackways joining, or not, the principal trackway.

A further object of the invention is to propose the possible implantation of a segment of circulation trackway with function of intercommunication between at least one principal circulation trackway and a by-pass trackway, such a segment being able to perform a function of two-way circulation.

According to the invention, such a segment for intercommunication is designed to allow the implantation of a common circulation section between two segments of rectilinear trackways capable of being passed over in the two directions of circulation by rolling carriages. In other words, such a segment constitutes a module of orientation and of possible circulation in easily implantable between two segments of rectilinear trackways.

To attain the above objects, the free transfer machine according to the invention, of the type comprising, on the one hand, a circulation trackway established in relation with work stations and constituted by two rails defining vertical guiding surfaces and rolling surfaces and, on the other hand, independent rolling carriages which are borne, guided and driven along the trackway in order to transfer from station to station loads that they support and each comprising bearing wheels cooperating with the rolling surfaces and lateral guiding rollers cooperating with the guiding surfaces, each carriage comprising at least one lateral group of pivoting rollers located on the median transverse axis of the carriage, is characterized in that:

the circulation trackway comprises at least two rectilinear trackway segments making therebetween a given angle and between its segments a module for orientation of the carriages comprising:

a rolling plate extending in the plane of the rolling surfaces, and at least one lateral guiding slideway composed of two rectilinear sections of length at least equal to the half-length of the carriages and aligned with the lateral, vertical guiding surfaces homologue of one of the rails of the two segments of trackway, said sections being joined by a curved section substantially on a center located on the inside of said slideway with respect to the trackway.

the lateral group of pivoting rollers is adapted to cooperate with lateral guiding slideway.

BRIEF DESCRIPTION OF THE DRAWINGS

The invention will be more readily understood on reading the following description with reference to the accompanying drawings, in which.

DETAILED DESCRIPTION OF THE PREFERRED EMBODIMENTS

Figure 1:
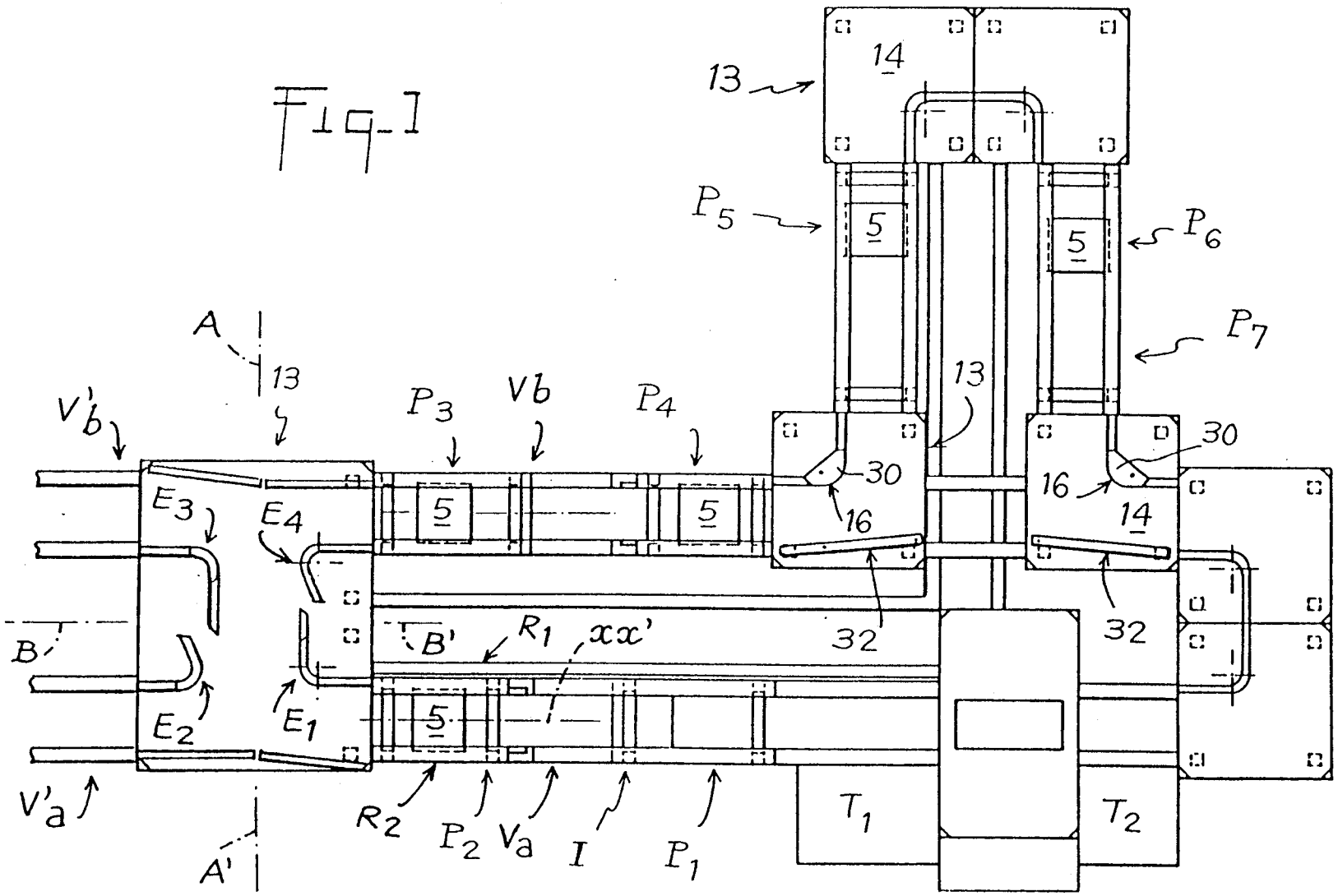
FIG. 1 is a schematic plan view illustrating a free transfer machine according to the invention.

Referring now to the drawings, FIG. 1 schematically shows a transfer machine according to the invention composed of a circulation trackway I enabling various workpieces or loads to be displaced between work stations $P_1$ to $P_7$. These work stations may be of any appropriate nature as a function of the interventions to be made, such as those consisting in the assembly, treatment, mounting, testing, machining of the loads or workpieces. Such stations are known to the man skilled in the art and do not have to be described in greater detail in the following specification.

Figure 2:
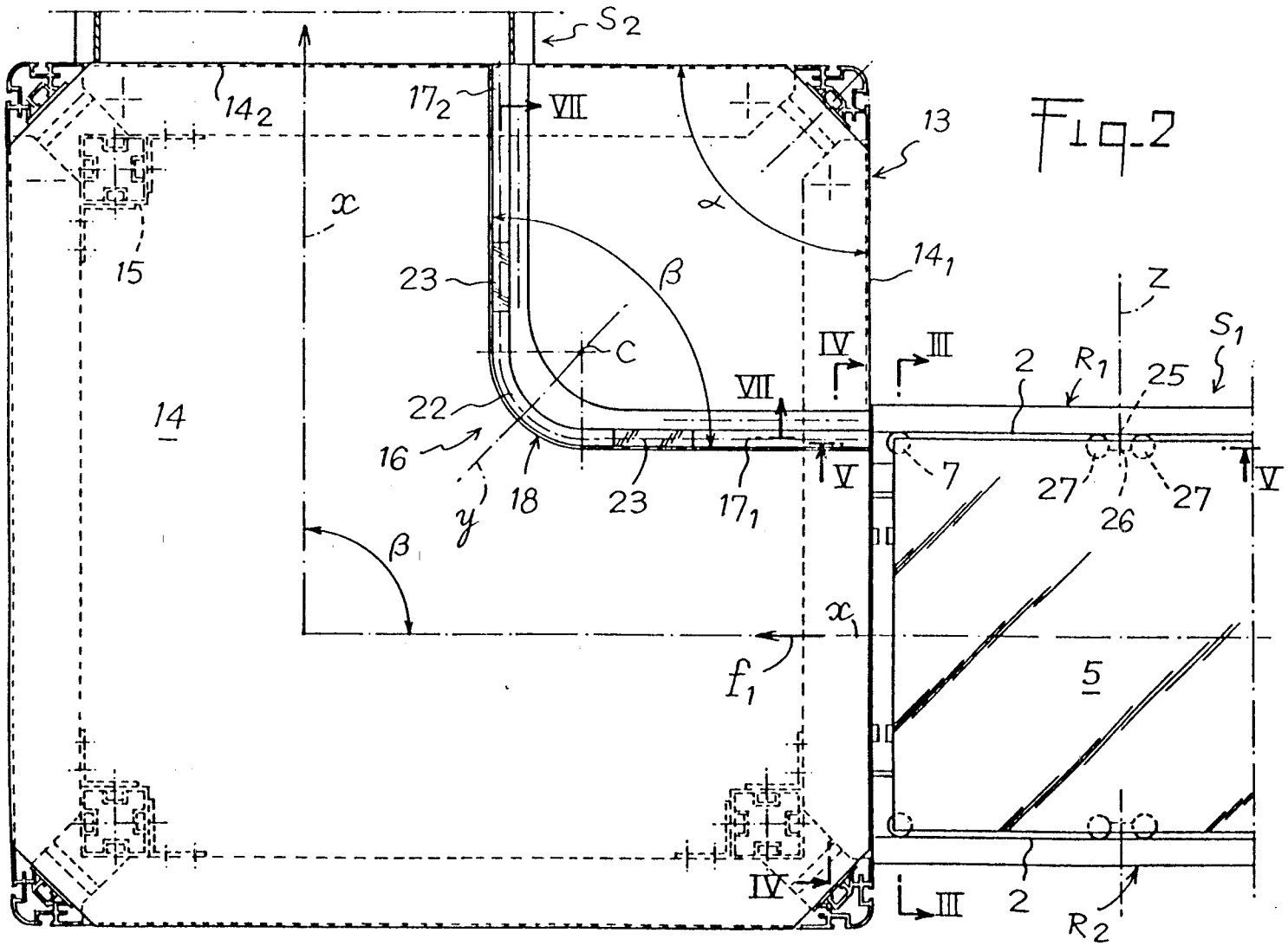
FIG. 2 is a partial view corresponding, on a larger scale, to FIG. 1.
Figure 3:
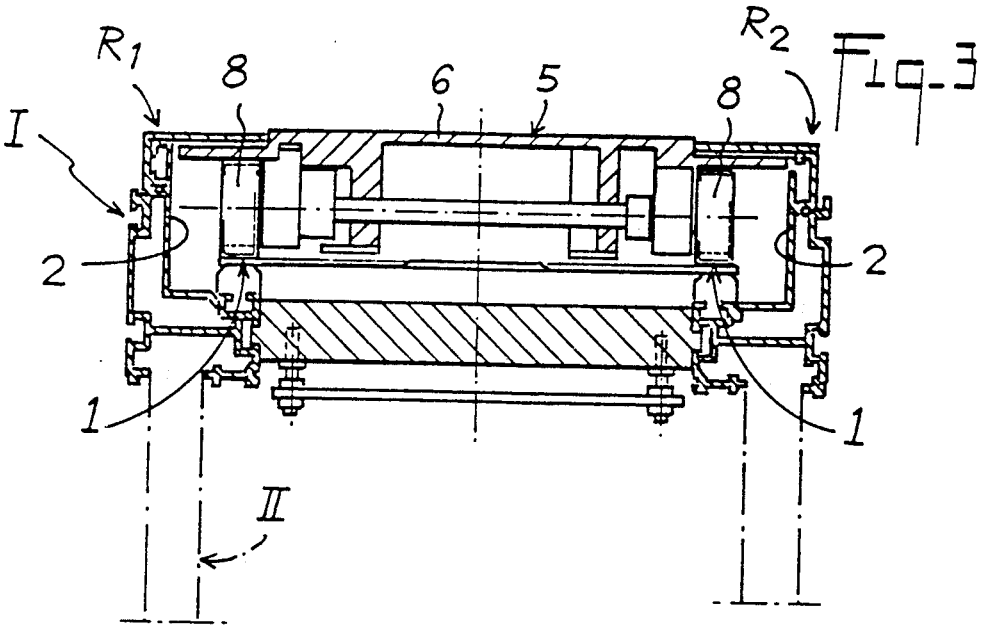
FIGS. 3 and 4 are transverse sections taken, respectively, along lines III—III and IV—IV of FIG. 2.
Figure 4:
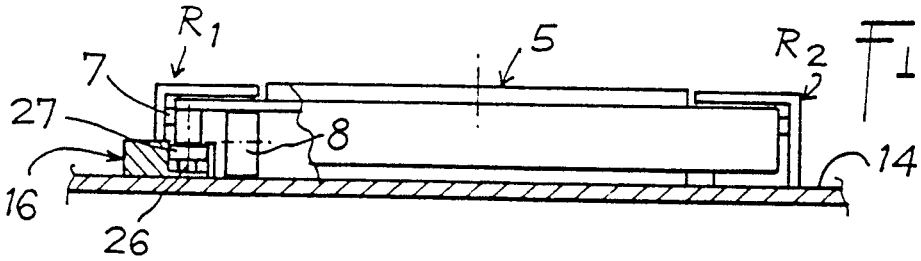
Figure 6:
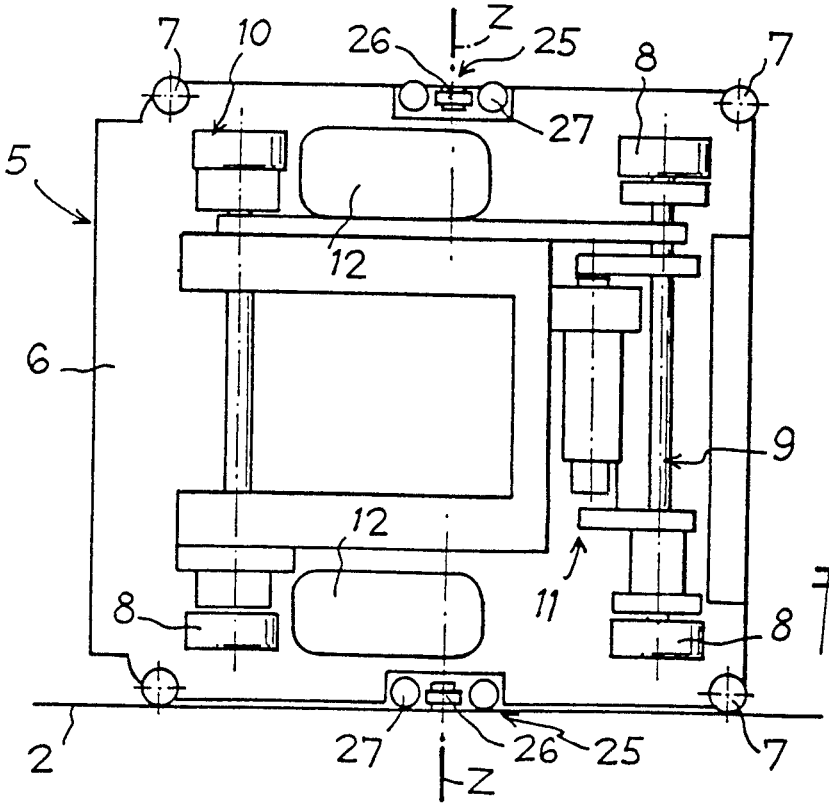
FIG. 6 is a plan view taken along line VI—VI of FIG. 5.

The circulation trackway I is established as a closed circuit between a table $T_1$ for loading the workpieces to be transported and a table $T_2$ for discharge thereof. The circulation trackway I is principally constituted, as shown in FIGS. 2 and 3, by two parallel rails $R_1$ and $R_2$ mounted on a bearing structure II. The rails $R_1$ and $R_2$ are made in any suitable manner to define, by their opposite faces, rolling surfaces 1 and lateral guiding surfaces 2, respectively horizontal and vertical, in consideration of a cross section transverse to the axis of symmetry x of the circulation trackway.

The surfaces 1 and 2 are intended to ensure support and guiding of motorized carriages 5 comprising, as shown in FIGS. 3 to 6, a plate 6 provided, on its upper face, with means ensuring the removable and centered fit of workpieces or loads having to be transferred from station to station. These means, commonplace in a transfer machine, are not shown in the drawings.

The plate 6 bears, on its lower face, rollers 7 projecting slightly with respect to the lateral faces to cooperate with the guiding surfaces 2. Furthermore, the lower surface of the plate 6 bears rolling members 8 adapted to cooperate with the surfaces 1. The rolling members 8 are preferably constituted by tire wheels in the form of a rear train 9 and a front train 10. The rear train 9 is associated with a driving unit 11, for example of the electrical type, supplied from on-board rechargeable batteries 12.

The free transfer machine, of the type described hereinabove, comprises, according to the invention, between two rectilinear segments $S_1$ and $S_2$ of circulation trackway (FIG. 2), a module 13 for orientation comprising a rolling plate 14 borne by a structure 15. The plate 14 is placed in the horizontal plane of the rolling surfaces 1 of the segments $S_1$ and $S_2$ to which it is connected by two adjacent sides $\mathbf{14}_1$ and $\mathbf{14}_2$ parallel to the transverse end edges of the segments $S_1$ and $S_2$ Sides $\mathbf{14}_1$ and $\mathbf{14}_2$ define therebetween an angle $\alpha$, equal to a given angle $\beta$ formed therebetween by the longitudinal axes x of the segments $S_1$ and $S_2$. In the embodiment shown in FIG. 2, the angles $\alpha$ and $\beta$ are equal to 90°. It must, of course, be considered that the angles $\alpha$ and $\beta$ may take any other angular value without departing from the scope of the invention.

Figure 4A:
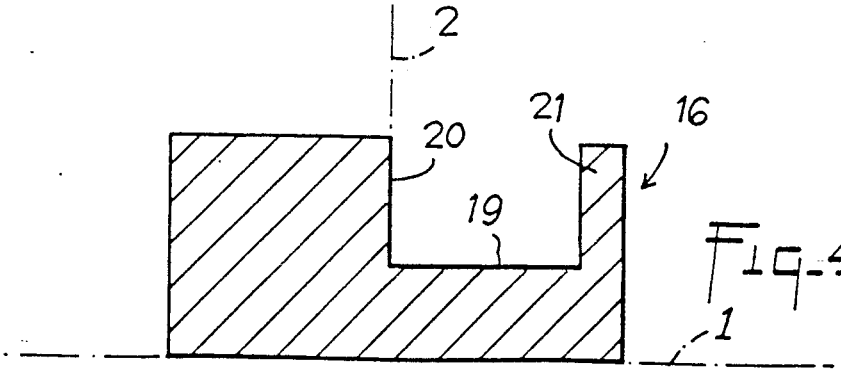
FIG. 4*a* is a transverse section showing, on a larger scale, a detail of FIG. 4.

Plate 14 supports a lateral guiding slideway 16 which is composed of two rectilinear sections $\mathbf{17}_1$ and $\mathbf{17}_2$, of length at least equal to half that of the carriage 5 and joined by a curved section 18. The slideway 16 is borne by the plate 14, so that its rectilinear sections 17 are aligned with the rails $R_1$ of the segments $S_1$ and $S_2$ located on the inner side with respect to the change in direction formed by segments $S_1$ and $S_2$. The slideway 16 is constituted by a section of transverse "U" cross-section presenting, as illustrated in FIG. 4*a*, a bottom 19 located in an elevated plane with respect to that of the rolling surfaces 1 and of the plate 14 and the lateral faces 20 and 21 parallel to one another. The lateral face 20, corresponding to sections $\mathbf{17}_1$ and $\mathbf{17}_2$, is aligned with the guiding surfaces 2 of the inner rails $R_1$ of segments $S_1$ and $S_2$.

The curved section 18 is substantially centred on a fictitious centre C located on the inside of the slideway 16 with respect to the circulation trackway. The curved section 18 is preferably defined by two substantially parabolic curves each developing in the extension of the corresponding rectilinear section and joining together on a geometrical axis y bisecting the angle $\beta$ defined between segments $S_1$ and $S_2$. The two curves constituting the section 18 may be symmetrical or dissymmetrical.

Figure 7:
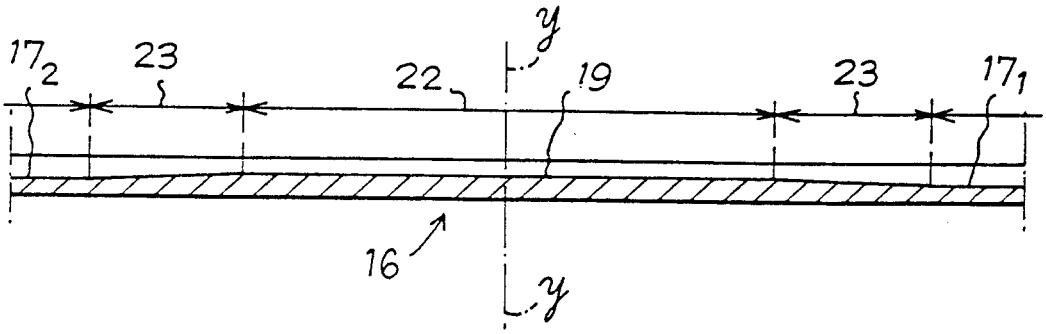
FIG. 7 is a view in transverse developed section taken on a larger scale along curved line VII—VII of FIG. 2.

The curved section 18 is made so that the bottom of the defined slideway comprises, as shown in FIG. 7, an elevated central part 22 joined by two inclined ramps 23 to the bottom of the rectilinear sections $\mathbf{17}_1$ and $\mathbf{17}_2$.

The slideway 16 may be constituted by an independent piece added to the roller plate 14 or may be machined directly from the latter.

The transfer machine according to the invention also employs, on at least one and preferably on both lateral sides of each carriage 5, a lateral group 25 of pivoting rollers fitted beneath the lower face of the plate 6. The group 25 comprises a so-called relief roller 26 whose horizontal axis of rotation lies on the transverse median axis z of the carriage 5. The relief roller 26 is disposed so as to be able to cooperate by rolling with the bottom 19 of the slideway 16.

Figure 5:
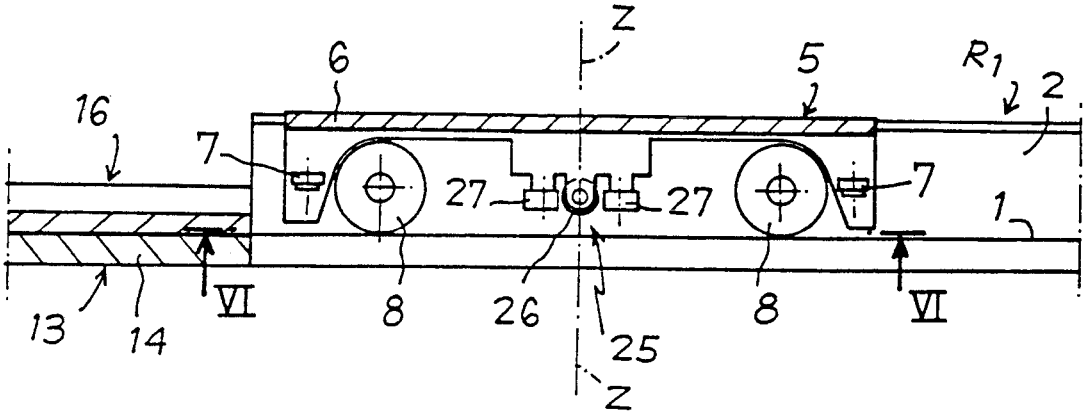
FIG. 5 is an elevational section taken on a different scale along line V—V of FIG. 2.

The group 25 further comprises, on either side of and at equal distance from the axis of the relief roller 26, two tracker rollers 27 whose parallel axes are perpendicular to the plane of the plate 6. The axes of rollers 27 are also disposed so that these rollers project laterally by the same amount as the guiding rollers 7. The rollers 27 are mounted so as to be located in a plane parallel to that of the plate 6 and lower than that of the rollers 7 which are disposed above the slideway 16 (FIG. 5).

The means according to the invention, as described hereinabove, ensure support and guiding of a carriage 5 on the trackway I and circulation thereof, for example, in the direction of arrow $f_1$ by its own means, for example along the segment $S_1$. Carriage 5 rolls via wheels 8 on the rolling surfaces 1, being laterally guided via the rollers 7 and the tracker rollers 27 cooperating with the guiding surfaces 2 of the rails $R_1$ and $R_2$.

When carriage 5 leaves segment $S_1$ and encounters plate 14, the front guiding rollers 7 abandon rails $R_1$ and $R_2$. However, carriage 5 continues its rectilinear path parallel to axis x of the segment $S_1$, being given that its guiding is always ensured by the rear guiding rollers 7 and by the tracker rollers 27 of the two lateral groups 25.

When substantially half the carriage 5 has left segment $S_1$, the first of the tracker rollers 27 of the lateral group 25 corresponding to the inner rail $R_1$ encounters the slideway 16, penetrating in the rectilinear section $17_1$. In this temporary state, guiding of the carriage 5 is always ensured parallel to axis x via the tracker rollers of the inner group 25 and by the rear guiding rollers 7. The effect of continuing displacement of the carriage 5, substantially in direction $f_1$, is to cause the two tracker rollers 27 of the inner group 25 to cooperate with the segment $17_1$.

When the tracker rollers 27 have passed over the whole length of the section $17_1$, the rear rollers 7 have abandoned the rolling surfaces 2 of the rails $R_1$ and $R_2$. The carriage 5 is then taken over solely by the section $17_1$, whilst rolling via wheels 8 on the plate 14.

The continued progress of the carriage 5 leads the relief roller 26 to climb the inclined ramp 23 and consequently to elevate the longitudinal side of the inner carriage 5 with respect to the centre C. Such relief, allowing only a support on the outer wheels with respect to centre C, occurs just before the tracker rollers 27 encounter the curved section 18. The rollers 27 then follow a curved path provoking pivoting of the carriage 5 which follows a bend orientation on the pivoting area constituted by the rolling plate 14. The elevation or relief of the inner side of the carriage 5 makes it possible to adopt a rear driving train 9 of the type with single drive shaft.

When the tracker rollers 27 leave the curved section 18, the carriage 5 is aligned parallel to axis x of the segment $S_2$. In this situation, the relief roller follows the inclined ramp 23 located downstream with respect to the direction of circulation and therefore progressively re-establishes the abutment of the wheels of the carriage inside the bend made. The carriage 5 again abuts by its four wheels on the plate 14 which it progressively leaves to penetrate inside segment $S_2$.

Inversely to what has been said hereinbefore, the front rollers 7 then cooperate with the guiding surfaces 2 of the rails $R_1$ and $R_2$ and ensure taking over of the carriage 5 which remains likewise guided by the tracker rollers 27 still cooperating with the slideway 16. When the carriage 5 is half engaged 10 in the segment $S_2$, the tracker rollers 27 of the two sides cooperate with the surfaces 2 of the rails $R_1$ and $R_2$ which take over guiding of carriage 5 again.

As follows from the foregoing, by simple means, it becomes possible to cause a carriage 5 to make bends of any determined angular amplitude between segments $S_1$ and $S_2$ constituting a circulation trackway I of which the path may thus be exactly arranged and chosen as a function of the configuration in plan having to be given thereto for a better adaptation or implantation of the work stations.

The means of the invention are of simple structure involving only a static cooperation and may therefore be provided without the cost price of a transfer machine being considerably increased.

The embodiment given above concerns the implantation of a module for orientation imposing on a carriage 5 a bend to the right in the direction of circulation of arrow $f_1$. It must, of course, be considered that the means of the invention make it possible to produce a module of orientation imposing on the carriage 5 a bend to the left. In such a case, the slideway 16 is disposed symmetrically in order to be aligned with the rail $R_2$ which then constitutes the inner rail with respect to centre C.

By way of example, FIG. 1 shows that it is possible to dispose two orientation modules 13 side by side when it is desired to impose a path of connection with double bend between two segments $S_1$ and $S_2$ of which axes x are in that case parallel.

Figure 9:
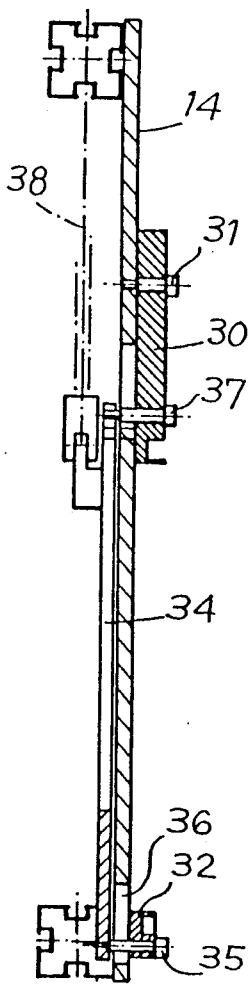
FIG. 9 is a transverse section taken substantially along line IX—IX of FIG. 8.
Figure 8:
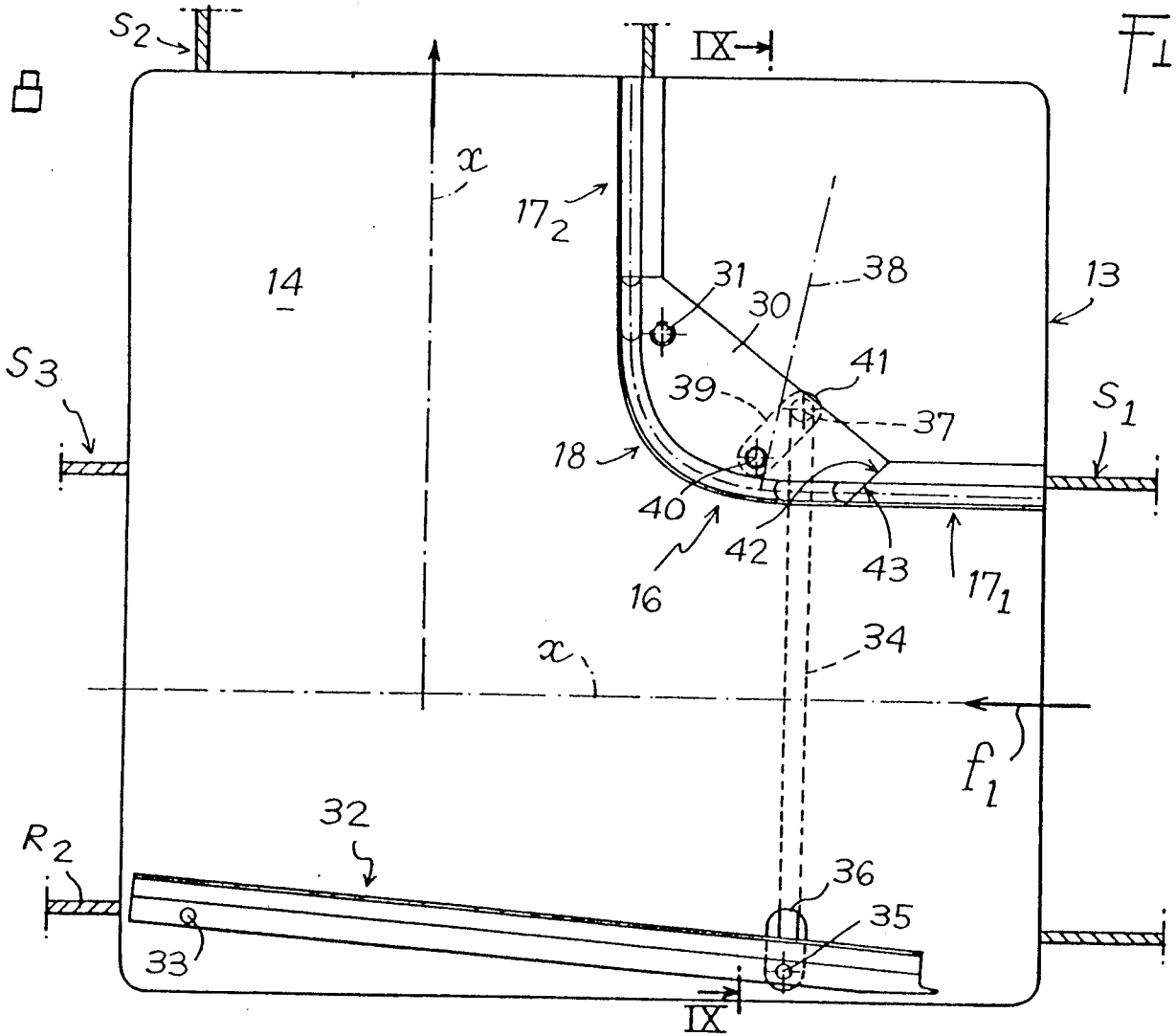
FIG. 8 is a plane view, similar to FIG. 2, but showing a variant embodiment.

FIGS. 8 and 9 show a development of the invention wherein the orientation module 13 is also made to perform a function of switching between a segment of circulation trackway $S_1$, considered as upstream with respect to the direction of circulation of arrow $f_1$, and one or the other of two segments $S_2$ and $S_3$ of which one makes a given angle with respect to segment $S_1$, whilst the other is in alignment with the latter.

Figure 10:
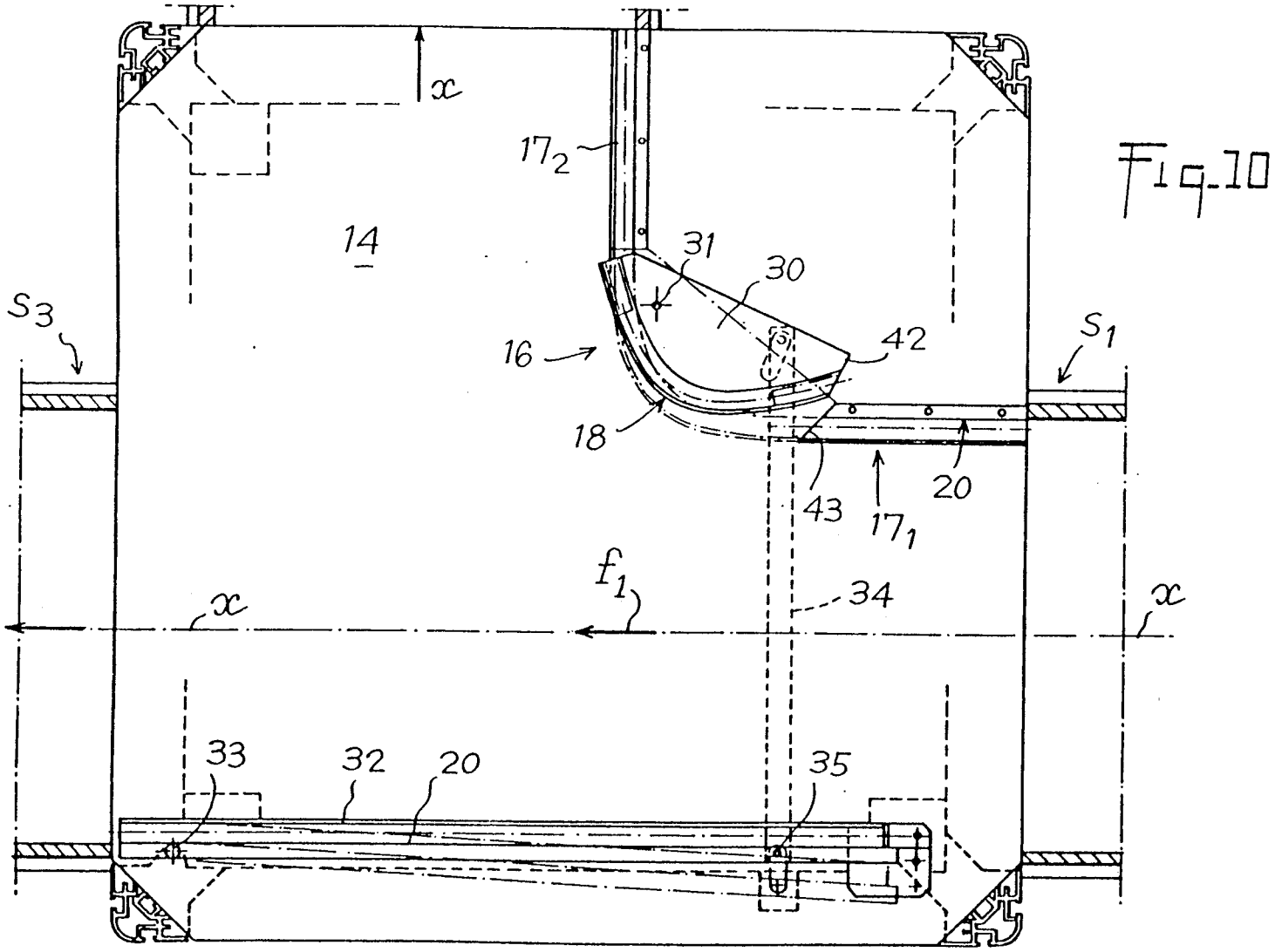
FIG. 10 is a plan view, similar to FIG. 8, but illustrating another characteristic position.

According to this variant, the slideway 16 comprises a section 18 constituted by a sector 30 responding to the same constructive characteristics as hereinabove, but made independently of the two non-contiguous rectilinear sections $17_1$ and $17_2$ borne by the plate 14. The sector 30 is mounted on plate 14 via a pivot 31 so as to be able to occupy a first position, in which it is exactly joined to sections $17_1$ and $17_2$, as illustrated in FIG. 8, or a second position, such as illustrated in FIG. 10, in which it is retracted with respect to segment $17_1$, so that the outer curved face of this section 18 is located at least in alignment with the face 20 of the section $17_1$.

FIGS. 8 and 9 show that the module 13 comprises, in addition, in this embodiment, guide members 32 constituted by a rectilinear segment of slideway whose transverse cross-section has the same shape as the sections $17_1$ and $17_2$. Guide members 32 are mounted on the rolling plate 14, via a vertical pivot 33 located near segment $S_3$ and substantially in line with the rail $R_2$ of the latter. Guide members 32 are coupled, by their terminal part near the segment $S_1$, to a small rod 34 disposed beneath plate 14. Connection between member 32 and rod 34 is ensured by a pin 35 passing through a slot 36 made in the plate 14. The small rod 34 is also coupled by a pin 37 to a driving member 38 fixed beneath the plate 14. The pin 37 bears a crank 39 articulated on sector 30 by a pin 40 traversing an oblong slot 41 in the plate 14. The length of the rod 34 is such that, in the position of the sector 30 connected with sections $17_1$ and $17_2$, the terminal part of the guide members 32 close to segment $S_1$ is offset outwardly with respect to the rail $R_2$ of this segment.

In this position, as illustrated in FIG. 8, a carriage 5 following segment $S_1$ is taken over by the slideway 16, as stated hereinabove, to be oriented in the direction of segment $S_2$ after having effected a bend on the plate 14.

When, on the contrary, a carriage 5 is to be switched in the direction of segment $S_3$, the driving member 38 is controlled to place the sector 30 in position of retraction with respect to the section $17_1$. In this position, illustrated in FIG. 10, the guide members 32 are urged to pivot on pivot 33, so as to be aligned, by face 20, with the guiding surfaces 2 of the rails $R_2$ of segments $S_1$ and $S_3$.

A carriage following segment $S_1$ thus progresses 30 in the direction of arrow $f_1$, abandons the guiding surfaces 2 of the rails $R_1$, $R_2$ of the segment $S_1$ and is taken over and guided by the tracker rollers 27 cooperating with the member 32. The carriage 5 is thus maintained in progression guided parallel to axis x, at the moment when it leaves the segment $S_1$ and during the whole of its displacement on the plate 14 ensured by member 32.

Taking over of carriage 5 by segment $S_3$ is effected by the cooperation of the front rollers 7 then by the tracker rollers 27, as soon as the latter progress inside the segment $S_3$.

The means according to the invention, described with reference to FIGS. 9 and 10, enable points to be easily made between two downstream by-pass trackways with respect to an upstream trackway or vice versa. It thus becomes possible to make configurations exactly adapted to the process of intervention having to be carried out or to the best choice of implantation of the work stations.

One of the features of the subject matter of the invention is to allow bends or switchings imposed on independent and motorized free carriages, without fundamental modifications to the structure of these carriages, apart from the adaptation of the groups of lateral rollers 25.

It should be noted that the means according to the invention essentially employ only a static cooperation therebetween. An adaptation may thus be ensured at a low cost, even on already existing transfer machines.

The simplicity of the means according to the invention makes it possible easily to make circulation trackways of more or less complex paths including by-pass trackways, in loop or not, allowing advance of the process of intervention, of variable cycles or frequencies, offering a real flexibility of use to such a transfer machine.

It should be noted that the segmented section 30 comprises an inclined transverse edge 42 adapted for connection with a complementary edge 43 presented by section $17_1$.

Figure 11:
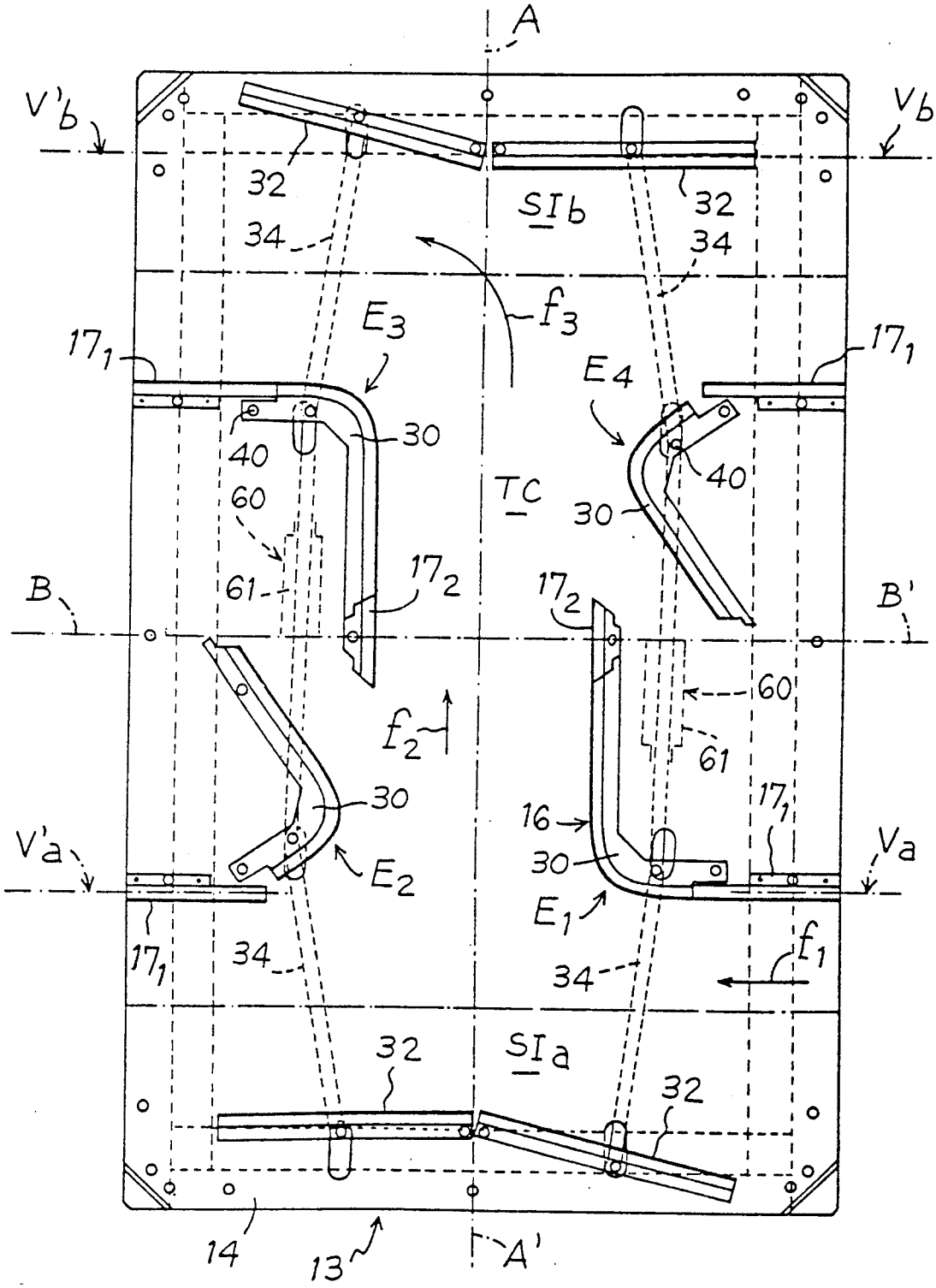
FIG. 11 is a plan view showing a development of the object of the invention.

According to the invention, it is also provided to constitute an orientation module 13 which is able to allow circulation between two circulation branches Va and Vb with passage from one to the other and, preferably, in both directions of circulation. Such a module 13, shown schematically in FIG. 1, is designed so that a carriage 5 circulating on branch Va may be by-passed towards branch V'b or vice versa or that such a carriage circulating on branch Vb may be by-passed onto branch V'a or vice versa. To that end, as illustrated in FIG. 11, the module 13 is designed to define a common section TC for circulation between the branches Va and Vb to which it is connected by two interposed segments of trackway SIa and SIb. The module 13 thus presents in plan an x configuration which is obtained by employing the following means.

The module 13 comprises a plate 14 which is interposed between branches Va, Vb and V'a, V'b to which it is connected as mentioned hereinabove. Plate 14 supports four assemblies $E_1$ to $E_4$ each constituted substantially as described with reference to FIGS. 8 and 9, being disposed in the example illustrated in opposition two by two symmetrically with respect to two perpendicular axes A—A' and B—B', viz. $E_1$ and $E_2$ on the one hand and $E_3$ and $E_4$ on the other hand, with respect to axis A—A', and $E_1$ and $E_4$ on the one hand and $E_2$ and $E_3$ on the other hand, with respect to axis B—B'. By way of example, it is shown that axis A—A' is perpendicular to axes x—x' of branches V which are parallel to one another.

Assemblies $E_1$ and $E_4$ are in addition connected by a control transmission 60 including an appropriate motorization 61 for simultaneously controlling the sectors 30 in reverse synchronous displacement. Such a control 60 is, for example, constituted by a double-effect linear jack directly connecting the articulations 40 of sectors 30. In this way, when the sector 30 of assembly $E_1$ is controlled for closure, sector 30 of assembly $E_4$ is controlled for retraction, each of the sectors acting by rod 34 on the concomitant position of the corresponding points 32.

Assemblies $E_2$ and $E_3$ are likewise connected by a control transmission 60 also including a motorization 61. In one embodiment, this control 60 acts in direction opposite the first, so that the sector 30 of assembly $E_2$ is retracted when sector 30 of assembly $E_l$ is closed and that the reverse applies for sector 30 of assembly $E_3$ with respect to sector 30 of assembly $E_4$ as illustrated in FIG. 10.

According to another arrangement, sectors 30 of assemblies $E_1$, $E_4$, on the one hand, and $E_2$, $E_3$, on the other hand, cooperate with common sections $17_2$ added on the plate opposite and on either side of axis A—A' at a distance such that the width of the common section TC of trackway is identical to the useful width of branches Va and Vb.

Module 13 offers the following possibilities of circulation.

In the state according to FIGS. 1 and 11, a carriage 5 circulating on branch Va in the direction of arrow $f_1$ encounters segment SIa then assembly $E_1$ which directs it towards the common section TC in the direction of arrow $f_2$. Interactive functioning is the same as that described with reference to FIGS. 2 and 8. During this progression, the carriage 5 is taken over by sector 30 in order then to engage sections $17_2$ simultaneously. Carriage 5 is then taken over by assembly $E_3$ which ensures guidance thereof in the direction of arrow $f_3$ to take the intermediate segment of trackway SIb leading it onto branch V'b.

Functioning may be identical in the case of reverse circulation of a carriage 5 arriving at module 13 from branch V'b.

In order to by-pass a carriage 5 circulating on branch Vb in the direction of branch V'a, it suffices to supply the controls 60 in order to close the sectors 30 of assemblies $E_4$ and $E_2$ and simultaneously to open the sectors 30 of assemblies $E_1$ and $E_3$. Such a state also allows the by-pass of a carriage 5 circulating on branch V'a in the direction of branch Vb.

It must be considered that the controls 60 may also be the subject of individual selective actuation. In this way, it becomes possible to place the sectors 30 of assemblies $E_1$ and $E_2$, for example, in state of retraction, in order to establish, by the intermediate segment SIa, the continuity between the branches Va and V'a. In such a state, the common section TC is neutralized. Independently or concomitantly, the sectors 30 of assemblies $E_3$ and $E_4$ may remain in closed or retracted position depending on the independent putting into or taking out of service of branches Vb and V'b. 0 It must be considered that the module 13 is, in any case, made so that the length of the common section TC corresponds at least to the length of a carriage 5. In this way, section TC may be used as passage for communication or by-pass between two principal trackways and/or as section of garage for waiting for the branch in which a carriage 5 is to be engaged, to be free. For such use, it may be advantageous to provide the common section TC with two retractable end stops capable of being programmed or remotely controlled to contain one or more carriages in stand-by position.

In a second embodiment, it is possible to constitute module 13 from three assemblies, such as $E_1$, $E_3$ and $E_4$ in the absence, for example, of branch V'a. Module 13 then allows circulation of a carriage 5 from branch Vb to V'b or vice versa and from branch Va to V'b or vice versa, by an appropriate actuation, programmed or not, of controls 60.

The invention is not limited to the examples 5 described and shown, as various modifications may be made thereto without departing from its scope.

What is claimed is:

1. A free transfer machine having an orientation module to change a direction of travel of independent motorized carriages traveling between trackway segments defining an angle $\beta$ therebetween, each trackway segment having two parallel rails, each rail defining a rolling surface and a lateral guiding surface, each motorized carriage having lateral guiding rollers, rolling members to support the carriage on the rolling surfaces of the rails, lateral tracker rollers and relief rollers, wherein the orientation module comprises:

a) a rolling plate substantially co-planar with the rolling surfaces of the rails of the track segments;

b) a pair of rectilinear lateral guiding sections located on the rolling plate each being aligned with one of the rails of each trackway segment and defining the angle $\beta$ therebetween each lateral guiding section having a length at least as great as one-half the length of the motorized carriage; and, c) a curved section located on the rolling plate and operatively associated with the lateral guiding sections, the curved section defining lateral guide means adapted to interact with the lateral tracker rollers and relief rollers to change the direction of travel of the motorized carriages to enable the carriages to pass from one trackway segment to another.

2. The transfer machine of claim 1 wherein the curved section extends on either side of a bisecting axis of the angle $\beta$ defined between the rails of the two trackway segments that it joins.

3. The transfer machine of claim 1 wherein the relief rollers have a substantially horizontal axis of rotation located approximately on the median transverse geometrical axis of the carriage, and wherein two tracker rollers are located.

on either side of and at equal distance from a relief roller, the two tracker rollers having substantially vertical axes of rotation and projecting laterally from the motorized carriage by approximately the same amount as the lateral guiding rollers.

4. The transfer machine of claim 3, wherein the tracker rollers are located at a lower level than that of the lateral guiding rollers with respect to a top of the carriage and the lateral guiding rollers are located at a level higher than that of the rectilinear lateral guiding sections and the curved section.

5. The transfer machine of claim 1 wherein the lateral guide means comprises a groove defined by the curved section and the rectilinear lateral guiding sections having a transverse "U"-shaped cross-section with a bottom inner surface and side rolling faces respectively adapted to be controlled by the relief rollers and the lateral tracker rollers.

6. The transfer machine of claim 5 wherein the bottom inner surface of the curved section comprises an elevated central part, connected by two inclined ramps to two end parts located in the plane of the bottom inner surface of the rectilinear lateral guiding sections.

7. The transfer machine of claim 1 wherein the curved section is defined by two substantially parabolic curves each developing in the extension of a corresponding rectilinear lateral guiding section and joining together on a geometrical axis bisecting the angle $\beta$ defined between the rails of the trackway segments.

8. The free transfer machine of claim 1 further comprising:

a) means to pivotally attach the curved section to the rolling plate;

b) a guide member pivotally attached to the rolling plate; and c) actuating means to move the curved section and the guide member between first positions where the curved section is in alignment with the trackway segments and the guide member is out of alignment with the trackway segments, and second positions wherein the curved section is out of alignment with the trackway segments and the guide member is in alignment with the trackway segments.

9. The transfer means of claim 8 wherein the curved section and the guide member are attached to the rolling plate by pivots located downstream with respect to a direction of travel of the motorized carriages and are coupled, under the rolling plate, by a connecting rod actuated by a driving member.

10. The transfer machine of claim 9, wherein the curved section and the guide member are coupled to the connecting rod by pins traversing through oblong slots defined in the rolling plate.

11. The transfer machine of claim 8 wherein the guide member is disposed between a rail of a segment of an upstream trackway segment and a corresponding rail of a downstream trackway segment aligned with said upstream trackway segment.

12. The transfer machine of claim 8 wherein the guide member defines a groove having a transverse "U" cross-section adapted to cooperate with the lateral tracker rollers and the relief rollers of the motorized carriage.

13. The transfer machine according to claim 9 wherein the curved section has an inclined edge facing towards an upstream rectilinear lateral guiding section, and wherein the lateral guiding section has a complementary edge oriented toward the curved section.

14. The transfer machine of claim 8 wherein the trackway defines branches, and further comprising carriage switching means interposed between the branches and comprising a plurality of orientation modules oriented so as to selectively switch carriages between the branches wherein the curved sections and guide members of the orientation modules are connected by actuation controls and which define therebetween intermediate trackway segments interposed on the branches and a common section having a length at least equal to that of a motorized carriage and constituting a trackway for communication between the intermediate trackway segments.

15. The free transfer machine of claim 14 wherein the curved sections and guide members of the orientation modules disposed on the same side of a longitudinal axis of the common section are connected by the same control ensuring their simultaneous reverse actuation.

16. The free transfer machine of claim 15, wherein the controls of the two pairs of orientation modules disposed respectively on either side of a longitudinal axis of the common section are connected to the respective curved sections and guide members to ensure a reverse functioning of the curved sections sectors and guide members from one pair to the other.

17. The free transfer machine of claim 14, wherein four orientation modules are utilized.

18. The free transfer machine of claim 17 wherein the orientation modules disposed on the same side of a longitudinal axis of the common section cooperate by their curved sections with the common section.

19. The free transfer machine of claim 17 wherein the plurality of orientation modules are disposed to define therebetween a common section and such that the respective guide members define intermediate segments interposed between trackway branches.

* * * * *